US009443686B2

(12) United States Patent
Whitaker et al.

(10) Patent No.: US 9,443,686 B2
(45) Date of Patent: Sep. 13, 2016

(54) TRIP UNIT STRAIN RELIEF

(71) Applicant: EATON CORPORATION, Cleveland, OH (US)

(72) Inventors: Thomas Alan Whitaker, North Huntington, PA (US); Erik Russell Bogdon, Bridgeville, PA (US); Robert Stephen Estok, Moon Township, PA (US)

(73) Assignee: EATON CORPORATION, Cleveland, OH (US)

( * ) Notice: Subject to any disclaimer, the term of this patent is extended or adjusted under 35 U.S.C. 154(b) by 309 days.

(21) Appl. No.: 14/226,972

(22) Filed: Mar. 27, 2014

(65) Prior Publication Data

US 2015/0279604 A1 Oct. 1, 2015

(51) Int. Cl.

| | |
|---|---|
| ***H01H 73/00*** | (2006.01) |
| ***H01H 71/02*** | (2006.01) |
| ***H01R 13/58*** | (2006.01) |
| *H01H 71/08* | (2006.01) |
| *H01H 71/46* | (2006.01) |

(52) U.S. Cl.

CPC ..... *H01H 71/0207* (2013.01); *H01H 71/0228* (2013.01); *H01R 13/5812* (2013.01); *H01H 71/08* (2013.01); *H01H 71/465* (2013.01); *H01H 2071/086* (2013.01)

(58) Field of Classification Search

USPC ..... 361/115

See application file for complete search history.

(56) References Cited

U.S. PATENT DOCUMENTS

| | | | | |
|---|---|---|---|---|
| 4,112,270 | A * | 9/1978 | Rys | H01H 71/462 200/307 |
| 5,206,468 | A * | 4/1993 | Kobayashi | H02B 11/133 200/50.23 |
| 5,541,561 | A * | 7/1996 | Grunert | H01H 9/42 335/132 |
| 6,236,294 | B1 * | 5/2001 | Zindler | H01H 71/52 335/167 |
| 6,323,748 | B1 * | 11/2001 | Malingowski | H01H 3/04 335/172 |
| 6,591,482 | B1 * | 7/2003 | Fleege | G01R 31/025 29/602.1 |
| 6,678,137 | B1 * | 1/2004 | Mason, Jr. | H02H 1/0015 361/103 |
| 6,822,543 | B1 * | 11/2004 | Subramanian | H01H 71/405 335/23 |
| 7,254,009 | B2 * | 8/2007 | Allen | H01H 9/0264 361/641 |
| 2005/0057333 | A1 * | 3/2005 | Subramanian | H01H 1/2058 335/202 |

FOREIGN PATENT DOCUMENTS

| | | |
|---|---|---|
| EP | 0 907 221 A2 | 4/1999 |
| EP | 1 975 964 A2 | 10/2008 |
| JP | 08050846 A | 2/1996 |

OTHER PUBLICATIONS

European Patent Office, "International Search Report and Written Opinion", PCT/US2015/016241, Jun. 5, 2015, 11 pp.

* cited by examiner

*Primary Examiner* — Dharti Patel

(74) *Attorney, Agent, or Firm* — Eckert Seamans Cherin & Mellott, LLC; John P. Powers; Grant E. Coffield

(57) ABSTRACT

A circuit breaker is described herein. The circuit breaker comprising: a first plurality of electrical wires to the circuit breaker; a strain relief connecting the plurality of electrical wires to the circuit breaker; a securing mechanism attaching the strain relief to the circuit breaker; and a plurality of tethers attached to the circuit breaker positioned over the strain relief.

8 Claims, 4 Drawing Sheets

TRIP UNIT STRAIN RELIEF

BRIEF DESCRIPTION OF THE DRAWINGS

For a more complete understanding of the present invention, including its features and advantages, reference is now made to the detailed description of the invention taken in conjunction with the accompanying drawing in which.

DETAILED DESCRIPTION OF THE INVENTION

While the making and using of various embodiments of the present invention are discussed in detail below, it should be appreciated that the present invention provides many applicable inventive concepts that may be embodied in a wide variety of specific contexts. The specific embodiments discussed herein are merely illustrative of specific ways to make and use the invention and do not delimit the scope of the invention.

When the wiring of a circuit breaker's trip unit is accidently disconnected, there will be a loss of trip unit communication and functionality. This happens either by normal occurrence of repeated breaker movement, or accidentally through rough handling of the wires. The customer may be unaware of the disconnection and mistakenly perceive this to be a malfunctioning breaker. This invention will prevent the accidental disconnection.

The invention is installed onto a trip unit of the circuit breaker at the time the wires are connected. The part's own geometry acts like a leaf spring that ensures a preload onto the wire connectors. The invention resists being flexed in the direction of the wire pull, thereby ensuring the connection's integrity. In addition, there is a tether to permanently attach the part to the trip unit to prevent loss of the part.

Figure 1:
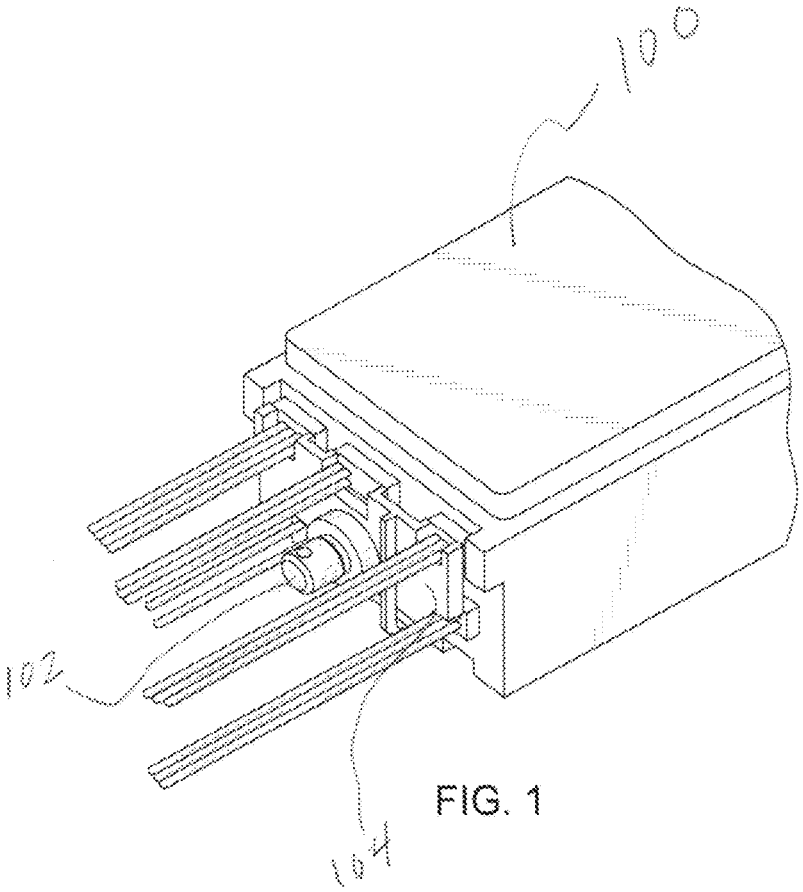
FIG. 1 illustrates a top perspective of an embodiment of circuit breaker 100 according to the current invention.

FIG. 1 illustrates a top perspective of an embodiment of circuit breaker 100. In this figure, a thumb screw 102 is shown along with a strain relief 104. This thumb screw 102 is used to attach the strain relief 104, along with electrical wires, to the circuit breaker 100.

Figure 2:
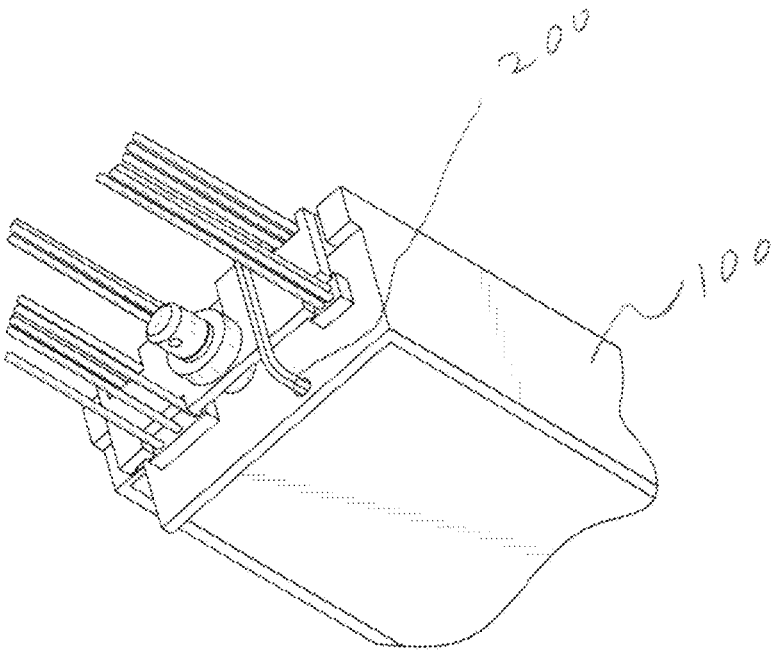
FIG. 2 illustrates a bottom perspective of the circuit breaker 100 of the embodiment of FIG. 1.

FIG. 2 illustrates a bottom perspective of the circuit breaker 100, the thumb screw 102, the strain relief 104 and a tether 200. The tether 200 dangles out of the way when the strain relief 104 is not installed. The tether 200 keeps the strain relief 104 from being lost when it is not installed on the circuit breaker 100.

Figure 3:
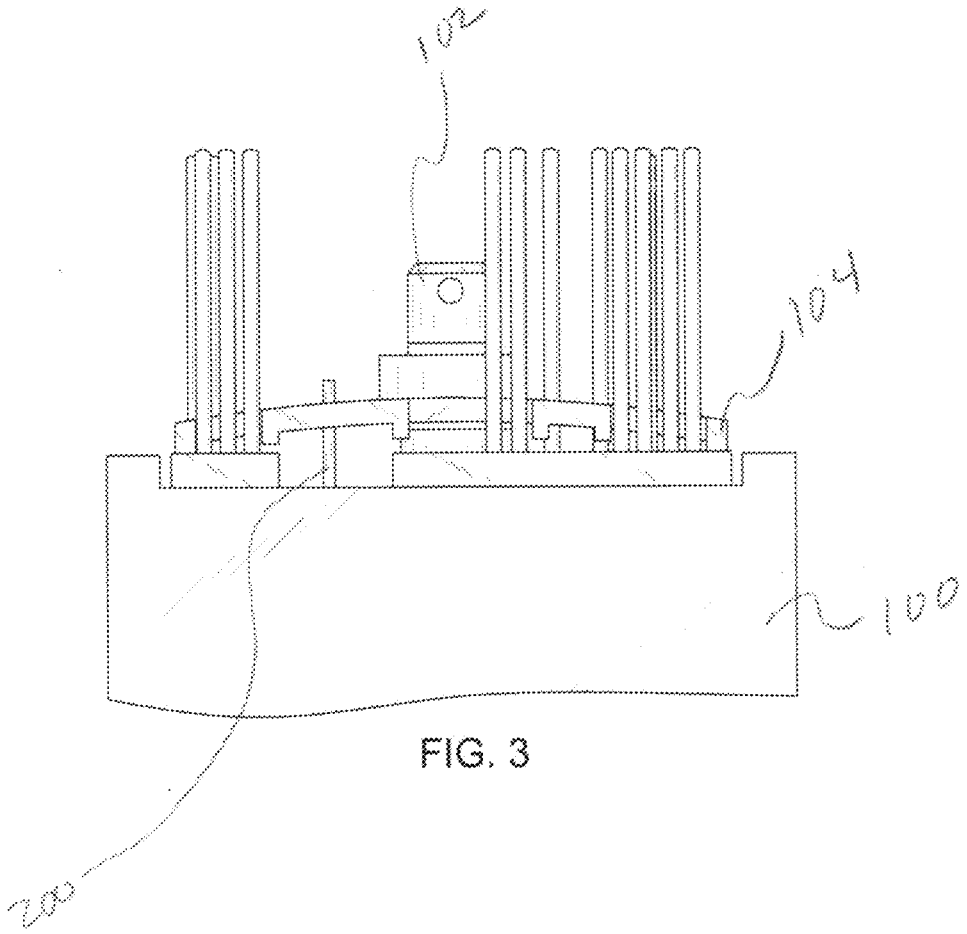
FIG. 3 illustrates a bottom view of the circuit breaker 100 of the embodiment of FIG. 1.

FIG. 3 illustrates a bottom view of the circuit breaker 100. In this figure, the thumb screw 102 is not fully threaded to the strain relief 104. Thus, the stain relief 104 is also not fully connected to the circuit breaker 100. In addition, the tether 200 is shown on the left of the figure.

Figure 4:
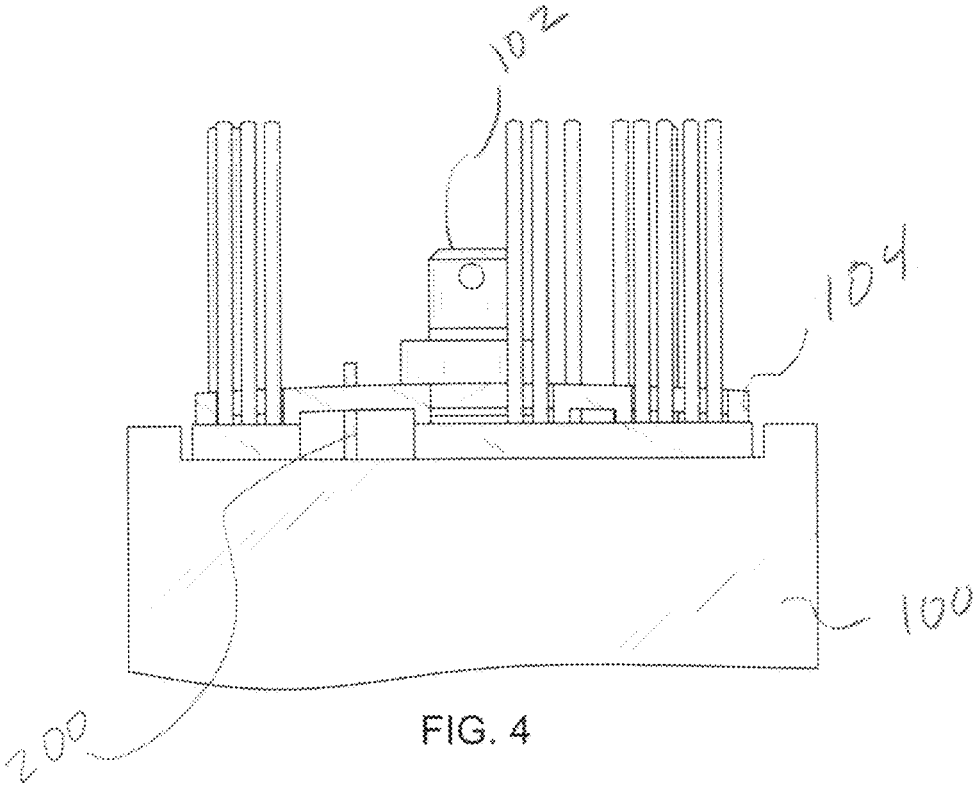
FIG. 4 illustrates another bottom view of the circuit breaker 100 of the embodiment of FIG. 1 according to the current invention.

FIG. 4 illustrates another bottom view of the circuit breaker 100. In this figure, the strain relief 104 is fully compressed by the thumb screw 102. Accordingly, the stain relief 104 is connected fully to the circuit breaker 100. In this position, the strain relief 104 flexes and provides as string tension thus providing resistance to the wires being pulled and ensures the integrity of the circuit breaker 100.

Although this invention has been described with reference to an illustrative embodiment, this description is not intended to limit the scope of the invention. Various modifications and combinations of the illustrative embodiments as well as other embodiments of the invention will be apparent to persons skilled in the art upon reference to the description. It is therefore intended that the appended claims accomplish any such modifications or embodiments.

We claim:

1. A circuit breaker comprising:

a first plurality of electrical wires extending into the circuit breaker from a location external to the circuit breaker;

a strain relief connecting the plurality of electrical wires to the circuit breaker;

wherein a tether is an integral part of the strain relief;

a securing mechanism attaching the strain relief to the circuit breaker, wherein the strain relief is structured to flex in order to resist accidental pulling of the electrical wires.

2. The circuit breaker of claim 1 wherein the securing mechanism is a thumb screw.

3. The circuit breaker of claim 1 wherein the tether provides protection of accidental loss of the strain relief.

4. The circuit breaker of claim 1 wherein one end of the tether is attached outwardly from the circuit breaker, over the strain relief and another end inwardly to the circuit breaker.

5. A circuit breaker comprising:

a first plurality of electrical wires extending into the circuit breaker from a location external to the circuit breaker;

a strain relief connecting the plurality of electrical wires to the circuit breaker;

a securing mechanism attaching the strain relief to the circuit breaker; and a tether attached to the circuit breaker positioned over the strain relief, wherein the strain relief is structured to flex in order to resist accidental pulling of the electrical wires.

6. The circuit breaker of claim 5 wherein the securing mechanism is a thumb screw.

7. The circuit breaker of claim 5 wherein the tether provides protection of the accidental loss of the strain relief.

8. The circuit breaker of claim 5 wherein one end of the tether is attached outwardly from the circuit breaker, over the strain relief and another end inwardly to the circuit breaker.

* * * * *